US005207162A

United States Patent [19]

Mismas

[11] Patent Number: 5,207,162

[45] Date of Patent: May 4, 1993

[54] EXPANDABLE TABLE

[76] Inventor: Phillip Mismas, 7519 Hawk Ave., Mentor, Ohio 44060

[21] Appl. No.: 869,808

[22] Filed: Apr. 16, 1992

[51] Int. Cl.[5] ..... A47B 1/00

[52] U.S. Cl. ..... 108/65; 108/69

[58] Field of Search ..... 108/63, 65, 69, 70, 108/78, 64, 66, 47, 38, 41, 33, 152

[56] References Cited

U.S. PATENT DOCUMENTS

| | | | |
|---|---|---|---|
| 637,391 | 11/1899 | Johnson | 108/70 |
| 796,334 | 8/1905 | Humphrey . | |
| 809,703 | 1/1906 | Kraemer et al. | 108/66 |
| 973,325 | 10/1910 | Waring . | |
| 2,609,072 | 9/1952 | Levinson | 108/33 X |
| 2,988,232 | 8/1958 | Koett . | |
| 3,648,628 | 3/1972 | Davis . | |
| 4,158,335 | 6/1979 | Belcastro et al. | 108/64 |
| 4,815,393 | 3/1989 | Pollak | 108/69 |

FOREIGN PATENT DOCUMENTS

| | | | |
|---|---|---|---|
| 986007 | 7/1951 | France | 108/69 |
| 296305 | 4/1954 | Switzerland | 108/69 |

OTHER PUBLICATIONS

Edson International Catalog, 1991, pp. 42–44.

Boat U.S. Catalog, 1991, p. 153.

*Primary Examiner*—Jose V. Chen

*Attorney, Agent, or Firm*—Watts, Hoffmann, Fisher & Heinke

[57] ABSTRACT

A cockpit table for boats is disclosed wherein a pair of leaves are provided for extending the table area. A storage compartment for the leaves is provided. The leaves have rods extending from their edges for engaging receptacles in the table edge. The rods of one leaf fit into holes formed in the other leaf when the leaves are stored in the storage compartment.

1 Claim, 4 Drawing Sheets

EXPANDABLE TABLE

BACKGROUND OF THE INVENTION

1. Field of the Invention

The present invention relates to tables, and more particularly, to expandable tables having storage compartments for table leaves.

2. Description of Related Art

Cockpit tables are a popular accessory for recreational boats. These are small tables which allow meals to be served on the main deck of a boat when anchored. Typically, these tables are hinged at one end to a pedestal guard adjacent to the steering pedestal in the cockpit of a boat. When not in use, these tables pivot about the hinge to an out-of-the-way, secured position.

Existing cockpit tables often have leaves for expanding the table area. In one such table, the leaves are hinged to opposite sides of the table. The leaves lie flat against the table when not in use. The leaves must be pivoted 180 degrees about the hinges to expand the table to its maximum size. A shortcoming of this design is that the leaves act as lever arms to bend the hinges. If much weight is placed on a leaf, the hinge will be ruined or distorted as would the hinge of a door if the door was forced beyond its normal travel. Another drawback of this design is that elastic bands or other devices must be employed to secure the leaves when the table is not being used.

In another proposed cockpit table design, rails are provided along the edges of the table on its upper surface. Separate leaves are provided with hooks which engage the rails for expanding the table. A shortcoming of this design is that the leaves may unhook if bumped. Also, the separate leaves must be stored and secured in some other part of the boat thus taking up valuable space. In addition, the rails and hooks create an uneven table surface. There is a demand for a compact cockpit table having sturdy, securable leaves which provide an even table surface and which store compactly, conveniently, and securely when not in use.

SUMMARY OF THE INVENTION

Basically, the table comprises a planar top member having an upper surface for serving as a table top and a plurality of receptacles formed in its edge. A plurality of planar leaves are adapted to connect to the top member to extend the surface area of the table. Each of the leaves includes a plurality of parallel rods extending from one edge. The axes of the rods are parallel to the surface of the associated leaf. The rods are adapted to fit into the top member receptacles when the leaf is connected to the top member. A plurality of receptacles are formed in the one edge, each being adapted to receive one of the rods when the leaves are stored. A storage compartment is located adjacent to the top member for storing the leaves. The leaves are adapted to fit into the storage compartment with the rods of one leaf fitted into the receptacles of an adjacent stored leaf.

BRIEF DESCRIPTION OF THE DRAWINGS

Preferred embodiments of the invention are shown in the accompanying drawings in which.

DESCRIPTION OF THE PREFERRED EMBODIMENTS

Figure 1:
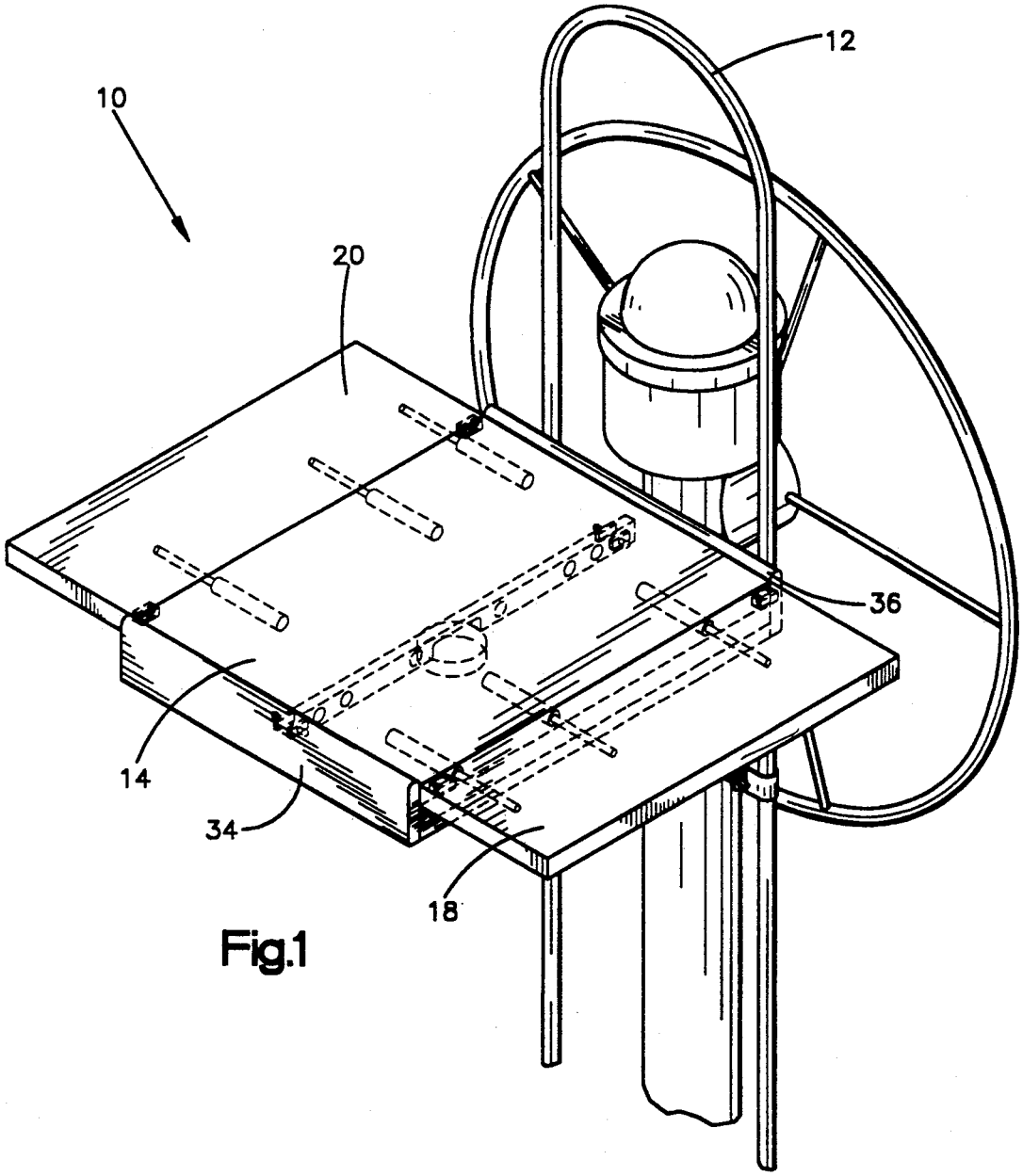
FIG. 1 is a perspective view of a table constructed in accordance with the present invention.

Referring to FIG. 1, a cockpit table 10 embodying the present invention is shown attached to a pedestal guard 12 which is secured to the deck of a boat (not shown). The table 10 includes a planar top member 14, a storage compartment 16, a pair of planar leaves 18, 20, a mounting hinge 22, and a support member 24. A plurality of parallel rods 26 extend from each leaf 18, 20. The rods 26 fit into receptacles 28 in the edge of the top member 14 for providing a strong connection between the top member and the leaves. The rods 26 and the receptacles 28 are accurately located to provide a perfectly planar extended surface when the leaves 18, 20 are in their operative position as shown in FIG. 1. When the table 10 is not in use, the leaves 18, 20 are stored in the storage compartment 16 and the table 10 is folded downward about the hinge 22 into a vertical position. The table 10 is preferably made of teak. The rods 26 and the mounting hardware are preferably stainless steel.

The top member 14 is a planar board having holes drilled in its edges to form the receptacles 28. In the preferred form of the table, a plastic sleeve 30 is fitted into each hole to provide an optimal wear surface for the rods 26. Also, the plastic sleeve 30 maintains a substantially constant hole size in spite of any shrinking or swelling of the top member 14 caused by moisture variations.

A bottom member 32, similar in size to the top member 14, is joined to the top member 14 by a front wall 34 and a rear wall 36. The bottom member 32 is fixed in a position spaced from and parallel to the top member 14. A hand-opening 38 is formed in the center of the bottom member 32 for permitting a person to easily remove the stored leaves 18, 20 by inserting their hand into the opening 38 and pushing on the edges of the leaves 18, 20. The bottom member 32 and the rear wall 36 are connected to the mounting hinge 22. A pair of fixtures 40, 42 pivotally connect the support member 24 to the bottom member 32.

A divider strip 44 is fastened in a center position between the top member 14 and the bottom member 32 and between the front and rear walls 34, 26 and divides the compartment 16 into two sections of equal size. The divider strip 44 serves to space the stored leaves 18, 20 apart which facilitates their removal by a hand inserted into the hand-opening 38. A plurality of holes 46 are drilled through the divider strip 44 to permit the rods 26 to extend through the divider strip 44 when the leaves 18, 20 are stored. A cut-out 48 is formed in the lower middle section of the divider strip 44 directly over the hand-opening 38. The cut-out 48 thus serves to facilitate the easy removal of the leaves 18, 20 from their storage position.

Figure 3:
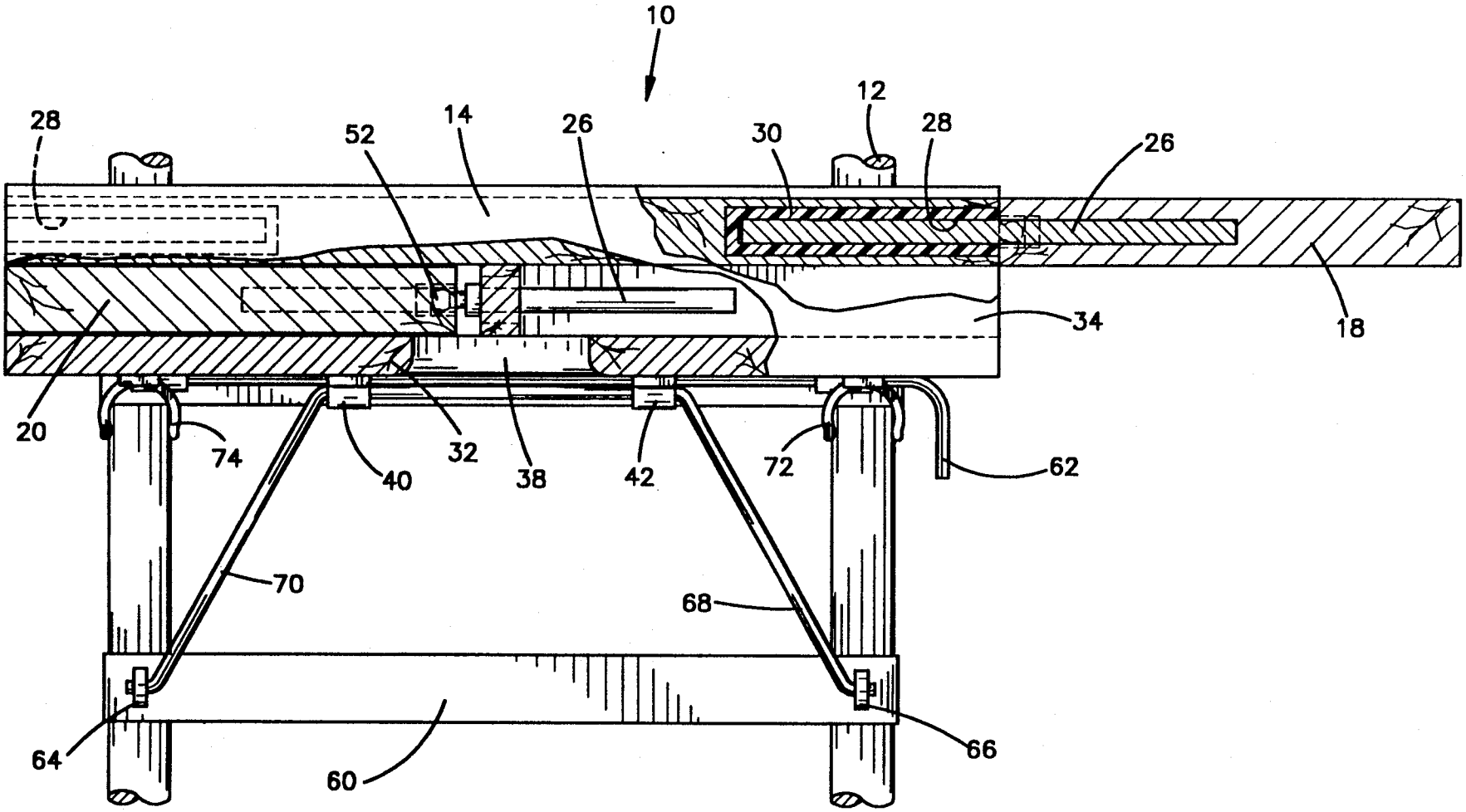
FIG. 3 is front elevational view of the table of FIG. 1 with portions broken away and with one leaf shown in use and one leaf shown in its storage position.

The space between the top and bottom members 14, 32 and between the front and rear walls 34, 36 forms the storage compartment 16. The sides of the compartment are open to permit insertion and removal of the leaves 18, 20. The space between the top and bottom members 14, 32 is slightly larger than the thickness of one leaf 18, 20 such that the leaves fit snugly into the compartment 16. As shown in FIG. 3, one leaf 18, 20 is preferably stored on each side of the divider strip 44 with the rods 26 of each leaf 18, 20 extending through the holes 46 and into the opposite section.

Figure 4:
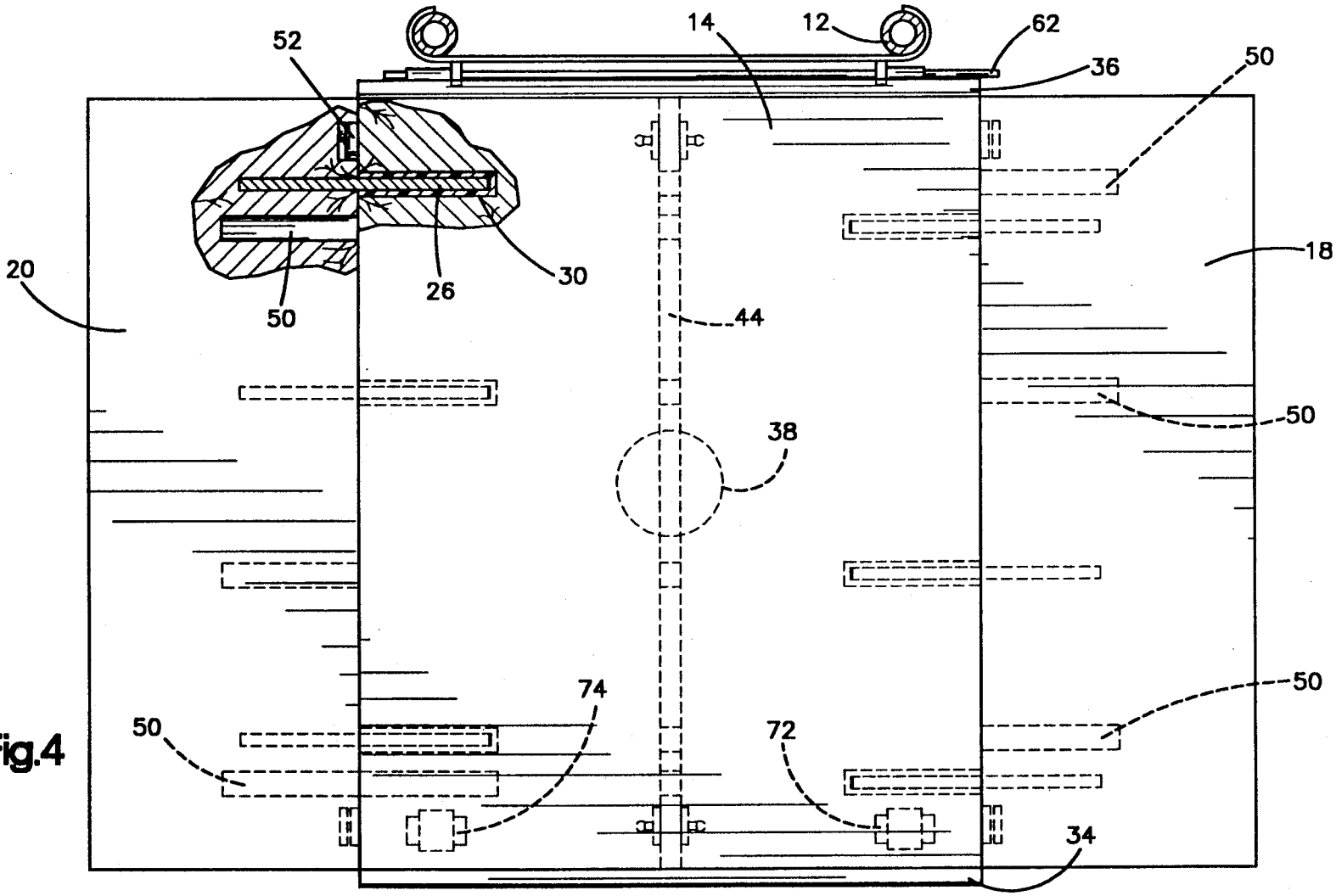
FIG. 4 is a top plan view of the table of FIG. 1 with portions broken away.

The leaves 18, 20 are planar boards with the parallel rods 26 extending from one edge. In the preferred embodiment, each rod 26 is approximately as long as the leaves 18, 20 are wide. Approximately one half of each rod 26 is securely anchored in one of the leaves 18, 20 with the other half extending from the edge thereof. The axes of the rods 26 are parallel to the surface of the associated leaf. As best seen in FIG. 4, each leaf 18, 20 includes receptacles 50, axes for receiving the rods 26 of the other leaf when both leaves 18, 20 are stored. This arrangement permits optimal compactness in storing the leaves 18, 20.

A plurality of catches 52 are provided to help secure the leaves into the operative and stored positions. Catches known as bullet catches are preferably used. The bullet catches 52 have a projecting part 54 which snaps into a receptacle part 56 when the two parts are compressed together. When the parts 52, 54 are pulled apart with a small force, they release and separate like a conventional snap fastener. In the preferred embodiment, projecting parts 54 are fixed to the divider strip 44 and to the top member 14 as shown in FIG. 4. The receptacle parts 56 are fixed in corresponding locations on the leaves 18, 20 to join their corresponding projecting parts 54 when a small force is applied. Thus, the leaves 18, 20 may be secured in their operative and stored positions, but may be removed by simply applying enough force to overcome the resistance of the bullet catches 52. The bullet catches 52 are preferably set in a countersunk hole such that the leaves 18, 20 fit flush against the top member 14 when in their operative position as seen in FIG. 3.

Figure 2:
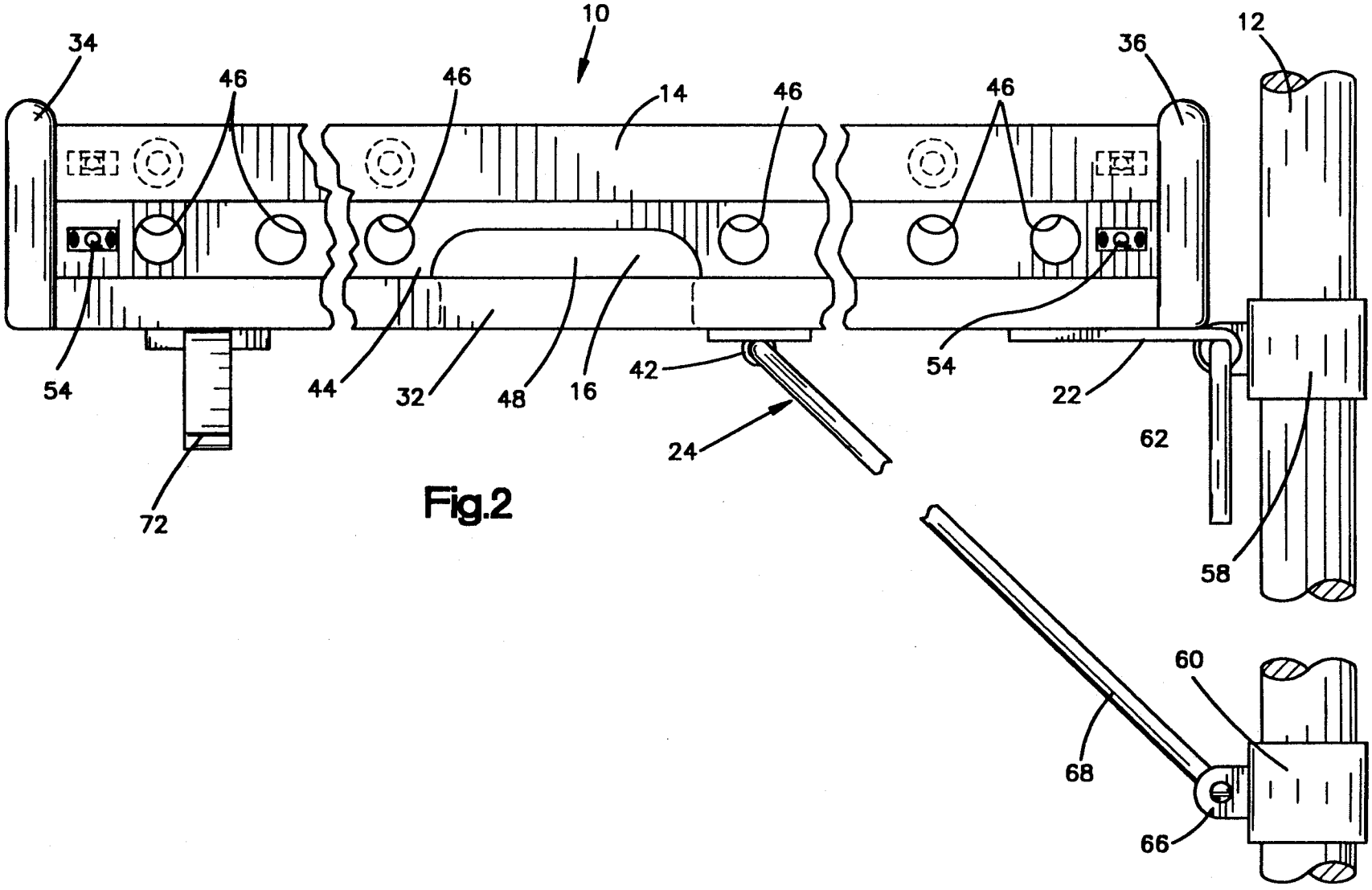
FIG. 2 is a side elevational view of the table of FIG. 1.

Conventional hardware is used to mount the table 10 to the pedestal guard 12 of the boat. Upper and lower brackets 58, 60 are connected to the pedestal 12 guard as seen in FIG. 2. The upper bracket 58 is adapted to connect to the mounting hinge 22. The table 10 may be removed from the pedestal guard 12 by removing a hinge pin 62. The lower bracket 60 connects the support member 24 to the pedestal guard 12. A pair of projections 64, 66 on the lower bracket 60 have holes formed therein for engaging a pair of support legs 68, 70 extending from the support member 24. When it is desired to fold the table 10 down into its vertical position, the legs 68, 70 are flexed inwardly to disengage their ends from the projections 64, 66. This permits the table 10 to pivot downward about the hinge 22. In the preferred form of the table 10, a pair of clips 72, 74 are fixed to the bottom member 32 in such a position to snap into engagement with the tubular legs of the pedestal guard 12 when the table is folded down. The clips 72, 74 serve to secure the table 10 in its vertical position.

While preferred embodiments of this invention have been described in detail, it will be apparent that certain modifications or alterations can be made without departing from the spirit and scope of the invention set forth in the appended claims.

I claim:

1. An expandable table comprising:

a planar top member having an upper surface for serving as a table top and a plurality of receptacles formed in its edge;

a plurality of planar leaves adapted to connect to said top member to optionally extend the surface area of said table, each of said leaves including:

a plurality of parallel rods extending from one edge, the axes of said rods being parallel to the surface of their associated leaf and adapted to fit into said top member receptacles when said leaf is connected to said top member;

a plurality of receptacles formed in said one edge, each being adapted to receive one of said rods;

a storage compartment located adjacent to said top member for storing said leaves, whereby said leaves are adapted to fit into said storage compartment with the rods of one leaf fitted into the receptacles of an adjacent stored leaf and wherein a divider member is centrally located within and connected to said storage compartment, said divider member having holes formed therein for receiving said rods when said leaves are so stored, said storage compartment being adapted to store at least one leaf on each side of said divider.

* * * * *